US005454128A

United States Patent [19]

Kwon

[11] Patent Number: 5,454,128

[45] Date of Patent: Oct. 3, 1995

[54] PREFABRICATED BRIDGE DECK FORM

[76] Inventor: Heug J. Kwon, 206 Ryerson Rd., Lincoln Park, N.J. 07035

[21] Appl. No.: 186,999

[22] Filed: Jan. 27, 1994

[51] Int. Cl.[6] ..... E01D 19/12

[52] U.S. Cl. ..... 14/73; 404/47

[58] Field of Search ..... 14/73, 73.1, 77.1; 404/134, 135, 136, 47; 52/334, 333

[56] References Cited

U.S. PATENT DOCUMENTS

| | | | |
|---|---|---|---|
| 2,114,773 | 4/1938 | Auten et al. | 14/73 |
| 3,260,023 | 7/1966 | Nagin | 404/47 X |
| 4,972,537 | 11/1990 | Slaw, Sr. | 14/73 X |
| 4,991,248 | 2/1991 | Allen | 14/73 |
| 5,311,629 | 5/1994 | Smith | 14/73.1 |

FOREIGN PATENT DOCUMENTS

| | | | |
|---|---|---|---|
| 2053308 | 2/1981 | United Kingdom | 52/334 |

*Primary Examiner*—Ramon S. Britts
*Assistant Examiner*—James A. Lisehora
*Attorney, Agent, or Firm*—Stanley J. Yayner

[57] ABSTRACT

A prefabricated metal deck form to provide bridge deck construction and/or bridge deck replacement. The construction is simplified to both shorten construction time and to save on construction costs. The deck form, including a concrete slab is sufficient to sustain both dead loads and heavy, live loads on a bridge.

13 Claims, 3 Drawing Sheets

22
22'
2
2
32
4
4
3
3
34
10
10
10
12
13
13
14
16
18
20
20'
20"
24
26
28
30
36
36
36'
38
42
44
51
51
56
64

22
22'
5
5
6
6
10
12
14
36
40
40
44
46
52
58
58
60
60
61
70

PREFABRICATED BRIDGE DECK FORM

FIELD OF THE INVENTION

This invention relates primarily to prefabricated bridge deck forms and, more specifically, to concrete slabs and metal deck forms for holding such slabs in a prefabricated construction.

BACKGROUND OF THE INVENTION

Bridge construction or bridge deck replacement has been a large and important industry all over the world since the advent of the era of the automobile. Road construction formerly was mapped out with the main consideration being a route which required only cut and fill as the limiting factor, since bridge construction was avoided wherever possible. As a result, the super cross-country highway was slow in becoming a primary long-distance transportation capability. When it became obvious that interstate and cross-country vehicle transportation was every bit as important as rail and airline transportation, the road engineering field set about to avoid bridge construction being a limiting factor in the cross-country road systems. Instead of being a limiting factor, bridge construction could be looked upon as a necessary "evil", but still a limiting factor with respect to both costs and the time required for construction. Furthermore, the repair of bridges also became an avoided maintenance requirement in the field of road upkeep. In other words, road repair was correctly recognized as an absolute necessity in maintaining the vehicular road form of transportation, but bridge repair was not considered with the same urgency because of the difficulties.

In terms of bridge construction, as it presently exists, the weak member is often the concrete deck slab, rather than the main beam members of the bridge support. Deck slabs must be sound enough to support the loads presented by the weight of moving vehicles, and if such slabs are worn away enough not to offer such support, they should be replaced. During replacement, traffic over the bridge could be completely disrupted during the time it takes to replace the slab. With conventional methods of bridge deck slab replacement, unreliable quality of such slabs often results and/or there is such high construction cost and traffic disruption that the replacement produces problems.

OBJECTS AND SUMMARY OF THE INVENTION

Accordingly, a primary object of the present invention is to provide a bridge slab construction which is quickly, easily and reliably provided in order to avoid high cost, minimum traffic disruption and unreliability.

A further and more particular object of the present invention is to provide a prefabricated bridge deck construction for use particularly for automobile support.

A still further object of the present invention is to provide a concrete bridge deck slab construction with metal forms in order to offer the advantages as stated in the foregoing.

These and other objects of the present invention are provided in a prefabricated deck form which features a concrete slab and metal plates for holding the conrete slab. Metal beam stiffeners are provided to be longitudinally welded to the metal plates for providing more rigidity and reinforcement in order to resist and withstand external and internal forces and surface cracks. The edges of the deck slab forms provide connection joints for reinforcement by metal channels to resist the concentration of stresses transferred from adjacent deck units. Each element of the prefabricated deck forms are tied to each other by reninforcement members bent into a U-shape, or by regular reinforcement splice, in order to enable such deck forms to perform as a single unit.

BRIEF DESCRIPTION OF THE DRAWINGS

Other objects, features and advantages of the present invention will become apparent by the following more detailed description of a preferred, but nonetheless illustrative, embodiment thereof, taken in conjunction with the following drawings.

DETAILED DESCRIPTION OF THE INVENTION

Figure 1:
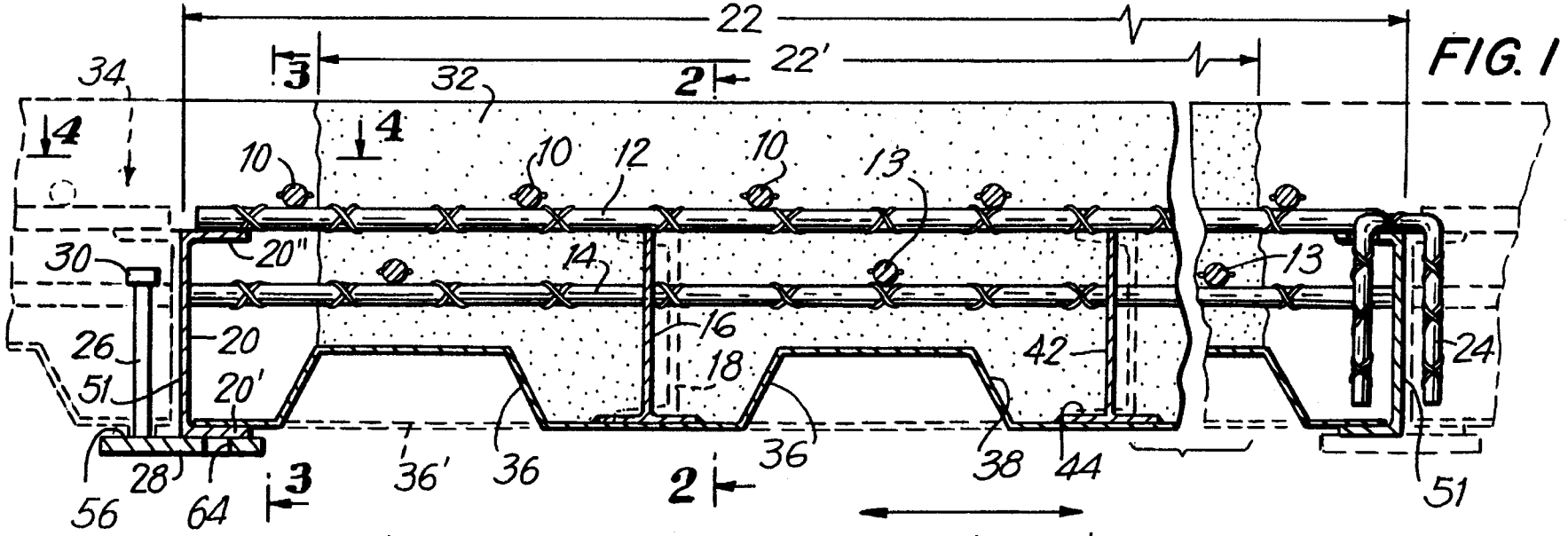
FIG. 1 is a cross-sectional view of a prefabricated deck slab form appearing in a direction in which primary tension and compression forces are acting.

Referring to the drawings, FIG. 1 represents a transverse sectional view of a prefabricated deck slab form according to the present invention. The form includes longitudinal reinforcement bars (rebars) 10 at the top layer, and optional rebars 13 at the second layer, arranged in the direction at which primary tension and compression forces are acting. Perpendicular thereto are first (top or upper) transverse bars 12 and second or lower transverse bars 14. Metal beam stiffeners (T-shape 16 or channel shape 18 or rectangular shaped tube beams) and channel shaped beam 20 along the edge of deck form 22, support the form vertically, so that a deck form unit 22 is enabled. U-shaped reinforcement bar 24, bent into a U-shape in order to connect the form at the ends, are provided and such connection bars 24 are hooked in place.

Connection shear studs 26 are welded to connection plates 28, which in turn, are welded to the bottom flange 20' of channel section 20. A light-gage (thin), corrugated metal plate 36, which is sometimes a simple planar thin metal plate 36', is provided so that concrete slab 32 is placed in the deck form as one unit of a prefabricated metal deck. An adjacent deck unit generally designated 34, which is shown to indicate the juxtaposition between such units, is sitting on metal plate 28 by passing the head 30 of shear studs 26 through openings 56 at bottom flange 20' of channel beam 20.

Thin metal plates 36 serve as deck forms, which hold concrete slabs in position until the concrete is hard enough to reach required strength. After that, the metal plates 36 form permanent stays in the concrete deck slab.

Thin metal plate 36 assists in forming the concrete 32, but are not counted as a stress member in the overall structure. Smooth contact surface 38 between forms 36 and concrete 32, cannot develop enough shear resisting force; accordingly, the metal beam stiffeners, such as T-shape section 16, are welded at bottom flange 44 of the metal beam stiffener to metal plate 36, to improve bonding shear strength between slab 32 and metal plate 36. In this way, metal plate 36 works as a tensile member in the composite deck slab. Alternatively, planar metal plate 36' is used to give greater rigidity to the deck form, but suffers somewhat from the drawback of providing for the unit 22 a greater amount of concrete dead weight.

Figure 2:
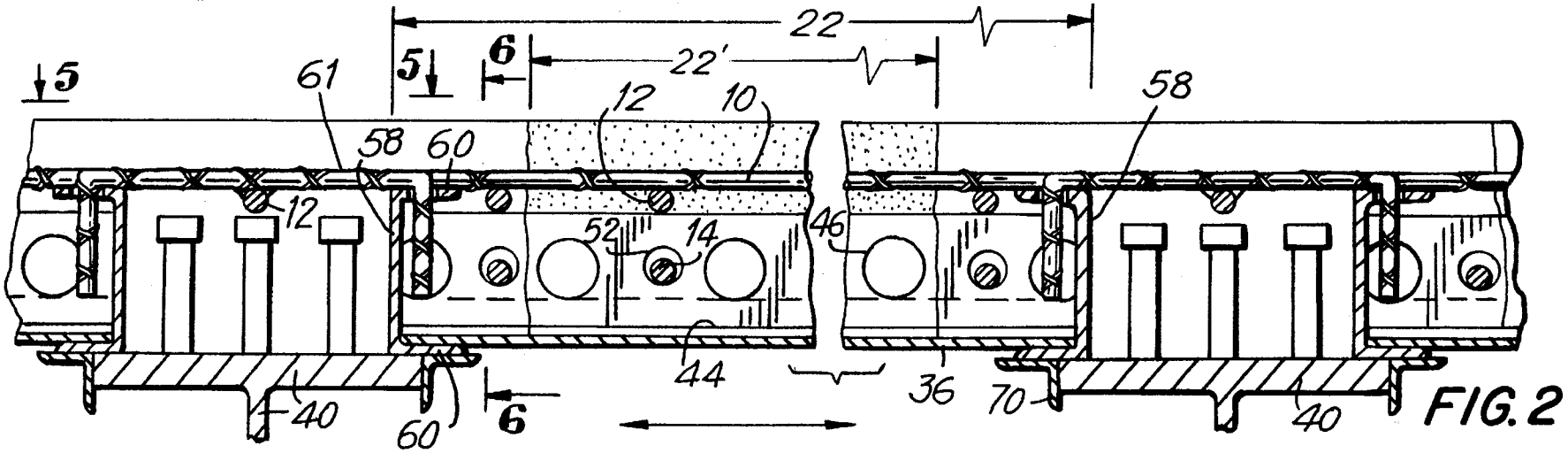
FIG. 2 is a side sectional view taken along the line 2—2 of FIG. 1.

By contrast, thin corrugated metal plate 36 is more efficient, in that it improves longitudinal rigidity of deck unit 22, whereby the longitudinal loads are carried to beams 40 (FIG. 2).

A metal beam stiffener, such as section beam 16, includes web 42 and bottom flange 44 as shown in FIGS. 1 and 2. Bottom flange 44 acts with corrugated metal plate 36 as a tensile member in the concrete slab 32. Web 42 functions, while imbedded in slab 32, to assist flange 44 and corrugated plate 36 to perform as tensile members in concrete slab 32.

Figure 3:
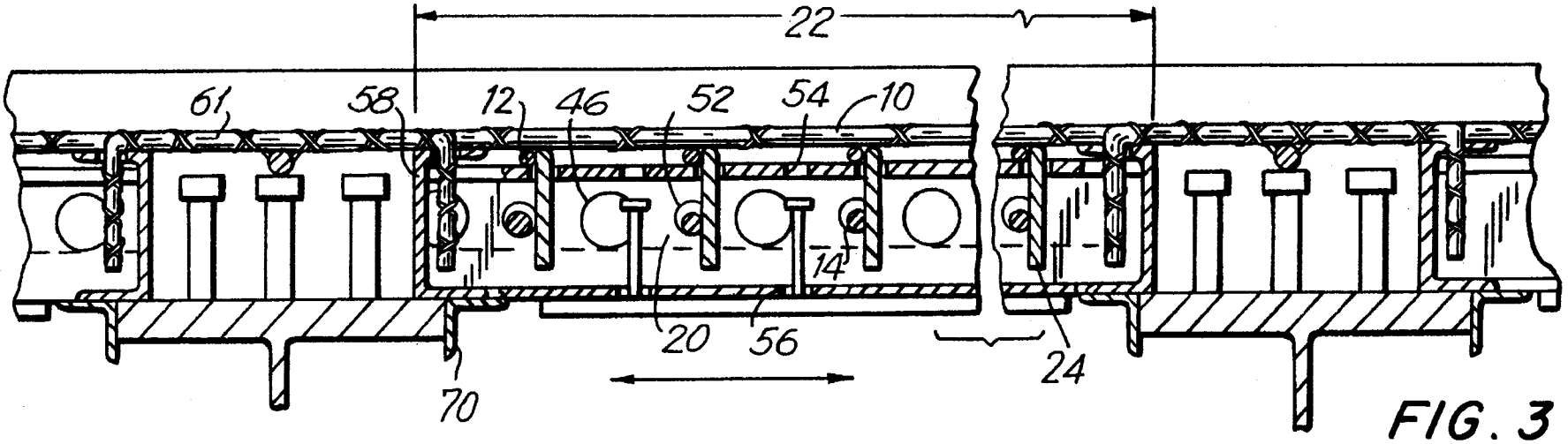
FIG. 3 is another side sectional view of the present invention, taken along the line 3—3 of FIG. 1.

FIG. 2 shows openings 46 defined by web 42, which are designed to improve the bond with the concrete. Transverse reinforcements 14 (FIGS. 2 and 3) pass through openings 52, and are defined to greatly improve concrete bonding to metal supports 16. The bar 13 at the second or lower layer can be optionally used to improve longitudinal rigidity, and to more evenly distribute loads to deck unit 22. The use of channel beams 18 (FIG. 1) (or rectangular tube beams) are useful when the deck form is subjected to more stress in the longitudinal direction, in order to support the dead load before concret slab 32 hardens; or to serve live loads when the metal deck form 22 is not completely filled with concrete, as depicted by 22' of FIG. 2.

Web section 42 of beam 16 holds reinforcements bars 10, 12, 13, 14 in their right location and improves longitudinal rigidity in the deck form 22. Transverse reinforcement bars 14 in the second or lower layer properly bond beam 16 to the concrete 32, so that the bottom thin plate 36 works perfectly as a tensile member in concrete slab 32. Also, reinforcement bars 14 and 12 improve the rigidity of the deck form 22 in a transverse direction, so as to make up for the weakness of the corrugated metal deck form 22 in transverse direction.

Reinforcement bars 12 and 14, running in a transverse direction in the top layer and lower layer, respectively, (FIG. 1), hold the main reinforcement bars 10 and optional longitudinal bars 13 in a proper location for when the concrete is poured into the deck form. These bars 12 and 14 distribute the loads properly to the reinforced concrete deck slab.

Main reinforcement bars 10 work as reinforcements against compressive and tension forces in the concrete slab 32, for serving satisfactorily in the bridge. Metal deck forms 22 are reinforced with channel members 20, so that such channel members 20 support major longitudinal force and stiffen the edge of the metal deck to sustain stress concentration transferred from an adjacent deck unit.

Reinforcement bars 12 are welded to the top flange 20" of channel member 20, so as to maintain all manner of transverse loads to edge channel section 20. Edge channel sections 20 resist bending and shear force in a longitudinal direction at the edge of metal deck form 22. The web of metal channel member 20 has both smaller openings 52 and larger openings 46. Concrete slab 32 is poured through openings 46, 52 to bond, and to tie adjacent channel members to each other, so that such edge channel sections 20 work as a unitary member in the concrete deck slab.

Figure 4:
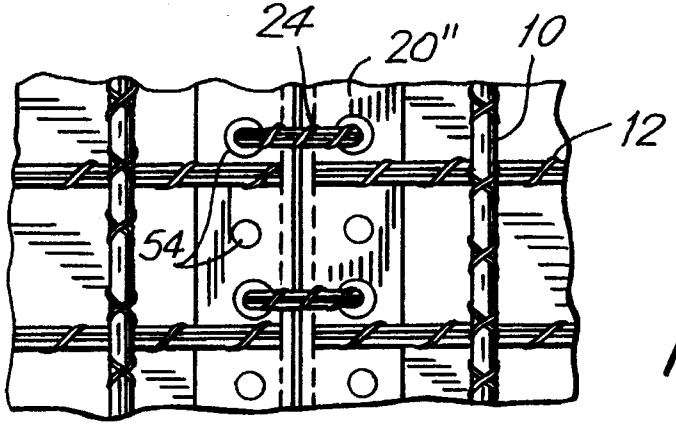
FIG. 4 is a partial, top, plan sectional view taken along the line 4—4 of FIG. 1.

The top flange 20" of the channel 20 has holes 54 or openings, through which the U-shaped bars 24 are hooked in through. Openings 54 (FIG. 4) function to hold the U-shaped bar reinforcements embedded in the concrete, so that tension or compression forces transmitted by transverse bars 12 to the top flange 20" of channel member 20 are successfully carried to the adjacent deck unit 34. The force with which the U-shaped connection reinforcements bars are embedded in concrete slab 32 are greatly improved by the interlocking mechanism of openings 54 of channel member 20. Another function of opening 54 is to improve the bonding of channel beam 20 to concrete slab 32 by concrete passing through the hole 54.

The bottom flanges 20' of the channel members 20 also have metal plates 28 welded through holes 64 and along the edge of bottom flange 20' of channel member 20. The function of plate 28 is to sustain tension forces in a transverse and longitudinal direction along the edge of deck form 22.

The shear studs are welded to metal plate 28 and embedded in adjacent concrete slab in deck form 34, so that metal, bottom plate 28 fully sustains the tension forces transmitted therein. Bottom plate 28 resists shear forces which occur along the edge of channel member 20.

The U-shaped connection reinforcement bars 24 which pass through hole 54 located near rebar 12 (FIG. 4) as to tighten together adjacent deck units 34, so as to provide a unitary operating concrete deck slab. The U-shaped reinforcement bars 24 sustain tension and compression forces and shear forces along the edge 51 of the deck unit.

Figure 6:
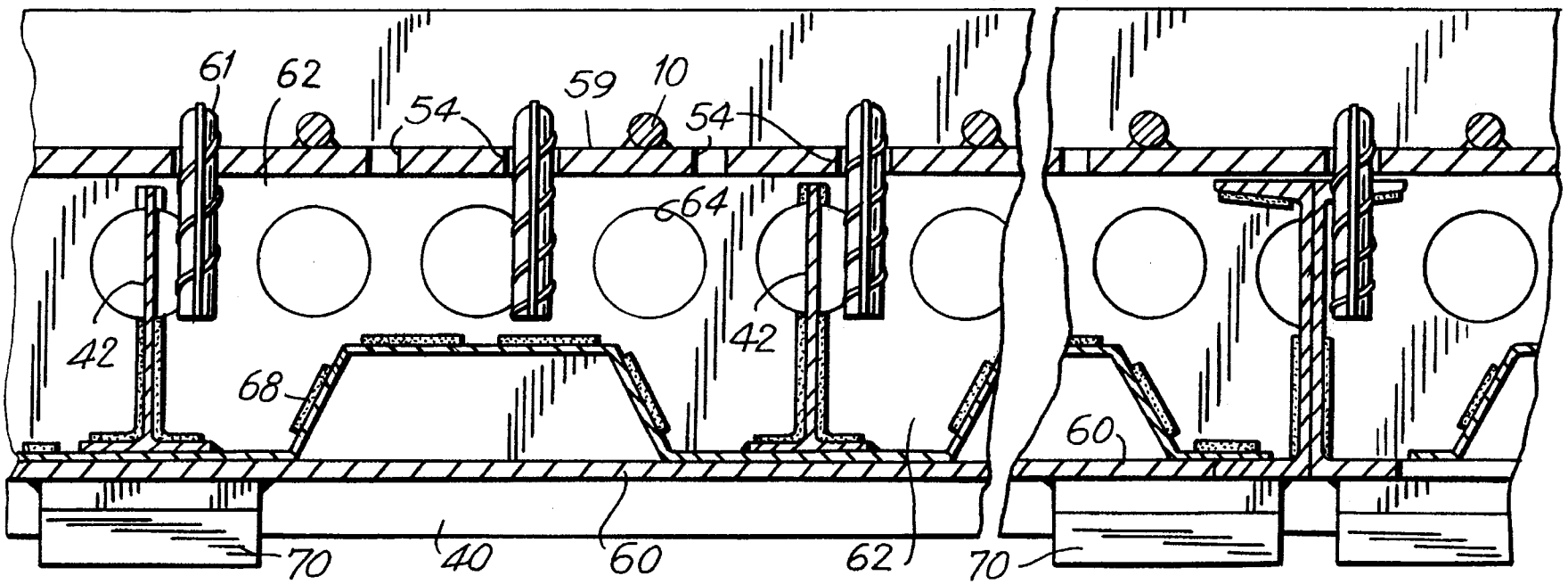
FIG. 6 is a partial cross-sectional view taken along the line 6—6 of FIG. 2.

Metal channel shape beam 58 works as a cap at both ends of the deck unit 22 shown in FIG. 2. The bottom of the flange 60 (FIG. 6) of channel member 58 works as a bearing plate for metal deck form 22, so as to distribute all of the loads from deck unit 22 to the top flange of beam 40. The longitudinal reinforcement bars 10 (FIG. 6) are welded to the top flange 59 of the channel member and the U-shape bars 61 are hooked into top flange 59 of channel shape beam 58 (FIG. 6). Top flange 59 of channel 58 works as a connection plate between the longitudinal bars 10 and the U-shape connection bars 61. Such top flanges 59 of channel 58 are strongly working against shear deformation, so that all of the force may be transmitted from the longitudinal bars 10 to the U-shaped connection bars 61.

Figure 5:
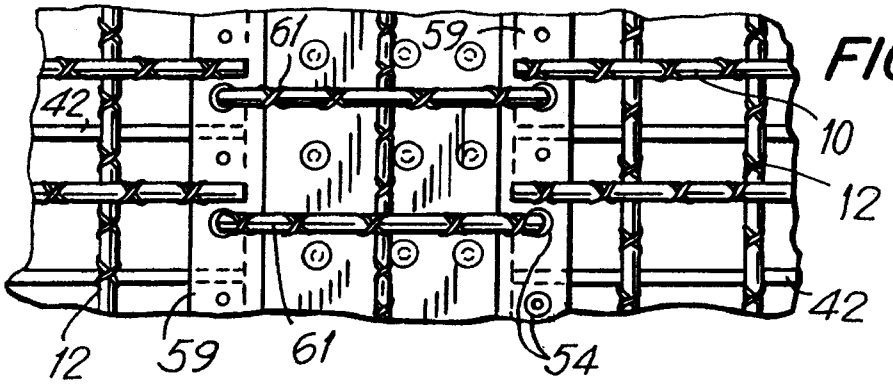
FIG. 5 is another partial top sectional view taken along the line 5—5 of FIG. 2.

The connection reinforcement bars 61, bent in U-shape, are embedded in concrete slab 32 through holes 54 (FIG. 5). The rebars 61 are located near reinforcement 10 welded to top flange 59, so as to transfer the tension or compression force from rebar 10 with a minimum of shear deformation for top flange 59. The strength of rebars 61, when it is embedded in concrete, is greatly improved by an interlocking mechanism, which is enabled by concrete bonding at rebars 61 through holes 54. Reinforcement bar 12 is connected to connection rebar 61 by welding, for construction convenience (FIG. 2), on top flange 40 of the main beam.

Web 62 (FIG. 6) of the metal channels 58 and the top flange 59 of channel 58 define large openings 64, and small openings 54, respectively, in order to improve concrete bonding to channel beam member 58. The ends of beam stiffeners 16, and the corrugated metal plate 36, channel beam 20 and end channel beam 58 are completely interconnected by welding so that the metal deck form may be successfully maintained, both before and after construction of the concrete deck slab.

The metal piece 70 is welded to the bottom flange 60 of the channel beam 58, all of which guides the metal deck form to set in the right location and to prevent the metal deck form from falling down.

According to the above description, a prefabricated bridge deck form is provided, but the description is not to be considered as a limitation of the present invention, whose delineation as to bounds is to be set only by the following claims:

What is claimed is:

1. A prefabricated bridge deck slab form having longitudinal ends and for supporting a concrete slab on a metal plate comprising a metal plate for providing longitudinal rigidity to said form, longitudinal and transverse reinforcement bars, longitudinally oriented channel shaped edge beams, beam stiffeners for supporting the deck slab form vertically, means for connecting said ends of the form, a metal channel shaped transverse beam cap at said longitudinal ends of said form, each of said channel shaped edge beams having a top flange and functioning to provide resistance for longitudinal forces, with said top flange resisting transverse loads, each of said longitudinal and transverse bars having lower and upper bars with respect to said vertical support beam stiffeners for supporting said reinforcement bars, and having a pair of said upper bars generally perpendicular to each other, and a pair of said lower bars generally perpendicular to each other, and a U-shaped reinforcement bar being hooked into said top flanges of said longitudinal edge beams for providing a connection for an upper of said transverse bars.

2. The invention according to claim 1 wherein said means for connecting said ends also includes a shear stud and a connection bottom plate, and said longitudinal edge beams having bottom flanges, said shear stud being connected to said connection bottom plate, which, in turn, is connected to one of said bottom flanges, which resists shear forces proximate said longitudinal edge beams of said deck slab form.

3. The invention according to claim 1 wherein said beam stiffeners and said longitudinal edge beams include bottom flanges connected to said metal plate.

4. The invention according to claim 1 wherein a metal channel shaped transverse beam cap is provided at both longitudinal ends of said deck slab form, a top flange for said cap and U-shaped bars hooked into said top flange, which function as a connection for said upper, longitudinal reinforcement bars.

5. The invention according to claim 4 wherein said upper longituidinal and transverse reinforcement bars are connected to said top flanges.

6. The invention according to claim 4 wherein each of said transverse beam caps includes a bottom flange connected to said metal plate for further supporting said deck slab form.

7. The invention according to claim 6, wherein said metal plate, said longitudinal edge beams, said beam stiffeners, and said channel shaped transverse beam cap are all reinforced and interconnected by welding.

8. The invention according to claim 6, wherein said channel shaped longitudinal edge beams, said beam stiffeners, said transverse beam caps, and said metal plate functions as a unitary member, with said slab to resist and maintain an external load.

9. The invention according to claim 4, wherein said channel shaped longitudinal edge beams, said beam stiffeners and said channel shaped transverse beam caps all define smaller and larger, generally rounded openings.

10. A prefabricated bridge deck slab form having ends and for supporting a concrete slab on a metal plate comprising a metal plate for providing longitudinal rigidity to said form, longitudinal and transverse reinforcement bars, longitudinally oriented channel shaped edge beams, beam stiffeners for supporting the deck slab form vertically and means for connecting said ends of the form to ends of adjacent forms, a metal channel shaped transverse beam cap provided at ends of said deck slab form, each of said channel shaped edge beams having a top flange, each of said longitudinal and transverse bars having lower and upper bars and a U-shaped reinforcement bar hooked into said top flanges for providing a connection for an upper of said transverse bars.

11. The invention according to claim 10 wherein said form further includes a pair of said upper bars generally perpendicular to each other, a pair of said lower bars generally perpendicular to each other and said beam stiffener are for supporting said reinforcement bars.

12. The invention according to claim 11 wherein said upper longitudinal and transverse reinforcement bars are connected to said top flanges.

13. The invention according to claim 10 wherein said upper longitudinal and transverse reinforcement bars are connected to said top flanges.

* * * * *